US006058560A

United States Patent [19]

Gab et al.

[11] Patent Number: 6,058,560

[45] Date of Patent: May 9, 2000

[54] VAC-IN-A-BOX

[76] Inventors: Wayne Gerard Gab; Christy Archer Gab, both of 3714 46th St., Metairie, La. 70001

[21] Appl. No.: 09/128,536

[22] Filed: Aug. 4, 1998

[51] Int. Cl.[7] ..... A47L 5/38

[52] U.S. Cl. ..... 15/339; 15/314; 15/323; 15/352

[58] Field of Search ..... 15/323, 339, 352, 15/314

[56] References Cited

U.S. PATENT DOCUMENTS

| | | | |
|---|---|---|---|
| Re. 28,268 | 12/1974 | Autrand | 15/339 |
| 3,210,793 | 10/1965 | Waters | 15/339 |
| 3,977,037 | 8/1976 | Miyake et al. | 15/352 |
| 4,673,424 | 6/1987 | Range | 15/352 |
| 4,688,292 | 8/1987 | Schmiegel | 15/323 |
| 5,083,704 | 1/1992 | Rounthwaite | 15/314 |
| 5,740,581 | 4/1998 | Harrelson, II | 15/314 |

*Primary Examiner*—Theresa T. Snider

[57] ABSTRACT

A trash can which also houses a vacuum cleaner. The trash can has three compartments. One for housing a 30 gallon trash bag, a second for housing a vacuum hose and various vacuum attachments and a third for housing a vacuum motor and dust collection bag.

3 Claims, 5 Drawing Sheets

VAC-IN-A-BOX

BACKGROUND OF THE INVENTION

This invention relates to the transfer of small undesired particles such as dust, dirt, food or anything that would be vacuumed up in a normal household or office to a dust bag.

Prior devices for transferring these particles were not readily available for quick action.

BRIEF SUMMARY OF THE INVENTION

This invention is a waste basket that can be located in plain view in the kitchen or bath, garage or any room of the home or office. It doubles as both a waste can and a vacuum cleaner. It is always available for use in the room it is located in. The Vac-in-a-box remains in its same location during the actual vacuuming. There is a twenty-foot hose which stretches across the room.

The invention combines two essential clean up features into one system. Throwing waste and garbage away and picking up small particles off a floor leaving an area neat and clean. It is advantageous because everyone has a garbage can and vacuum cleaner. The Vac-in-a-Box system makes it easier on the consumer because both the garbage can and vacuum are in the same location and are easily accessible. The attachments are always at arms length and the time used in clean ups and returning to storage is drastically cut down. Clean up is no longer a hassle because it is so convenient. Separate storage space is no longer required.

The system can be sized to fit any area and any need of the consumer. Small 13 gallon cans may be used to accomodate the smaller family or compact size room or larger 30 gallon cans may be used to accomodate the larger family or room. It is also available for all types of consumers not only those in homes but also those in apartments and work offices. Any room can be benefited by the system's compact feature such as the kitchen, garage or dining area. The system is made with the safety of the consumer in mind by having a ground fault feature on each unit.

DETAILED DESCRIPTION OF THE INVENTION

Figure 1:
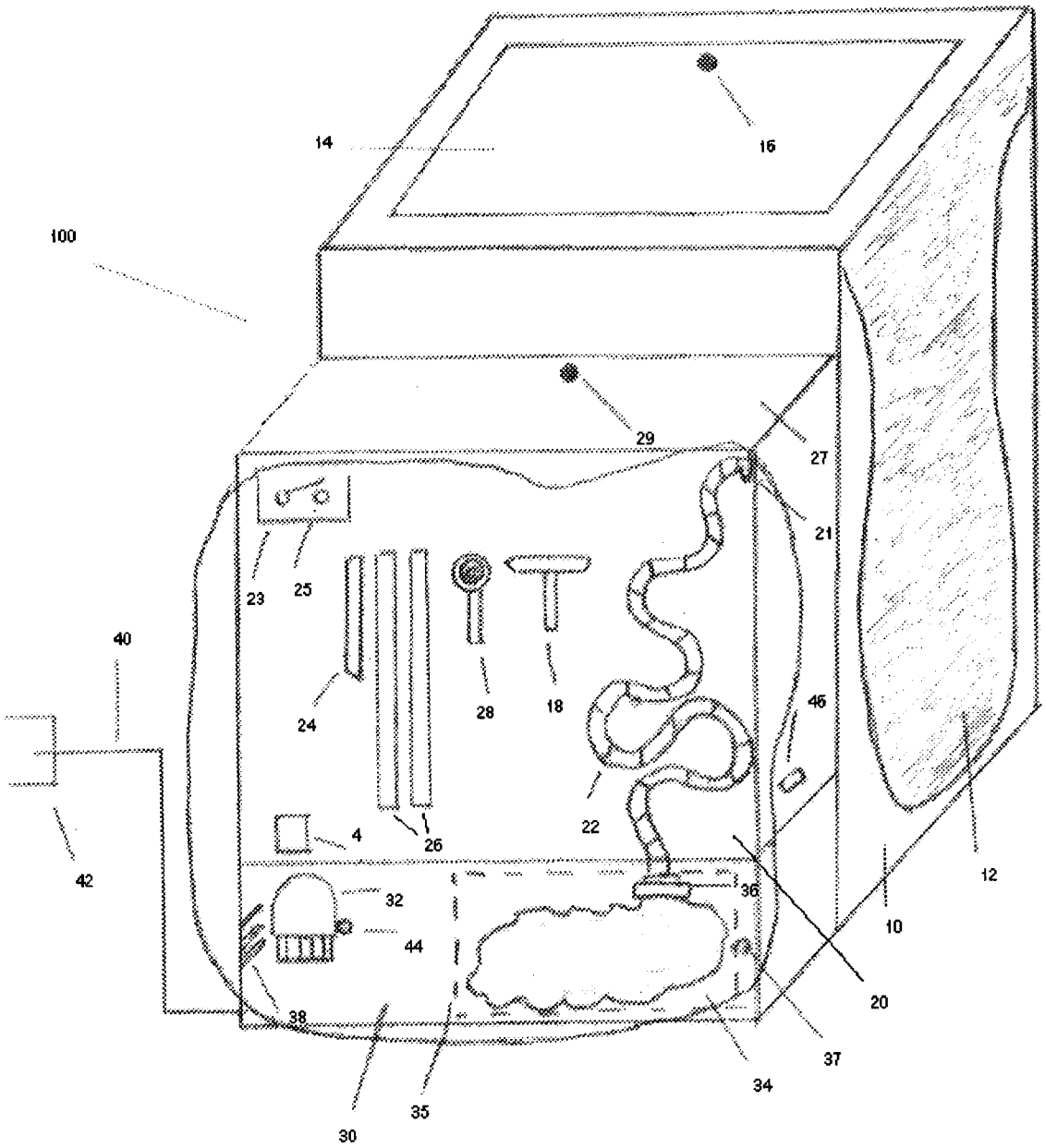
FIG. 1 is a rear view of our invention. It shows a cutaway view of the various parts.
Figure 2:
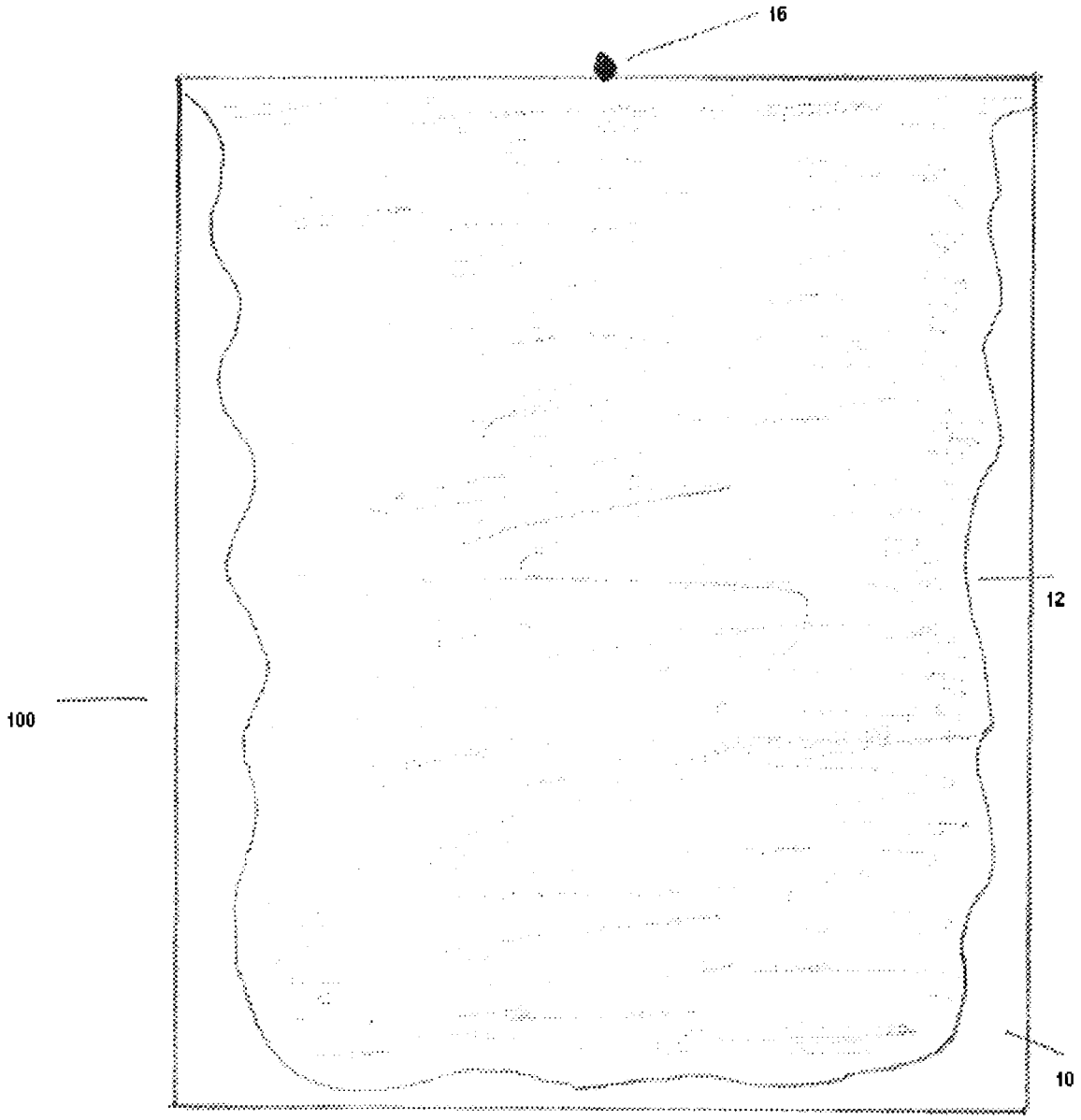
FIG. 2 is a front view.
Figure 3:
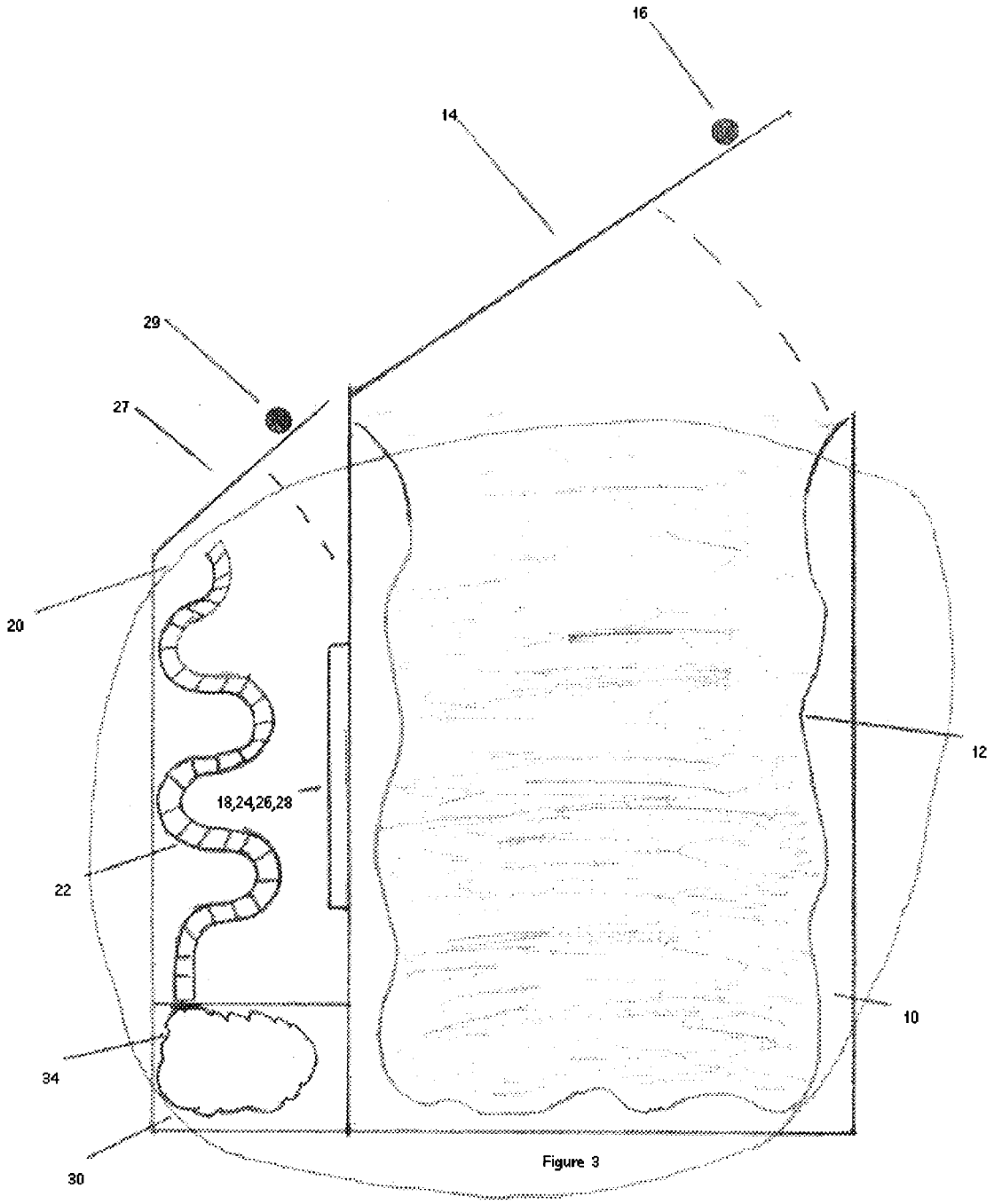
FIG. 3 is a left side view.
Figure 4:
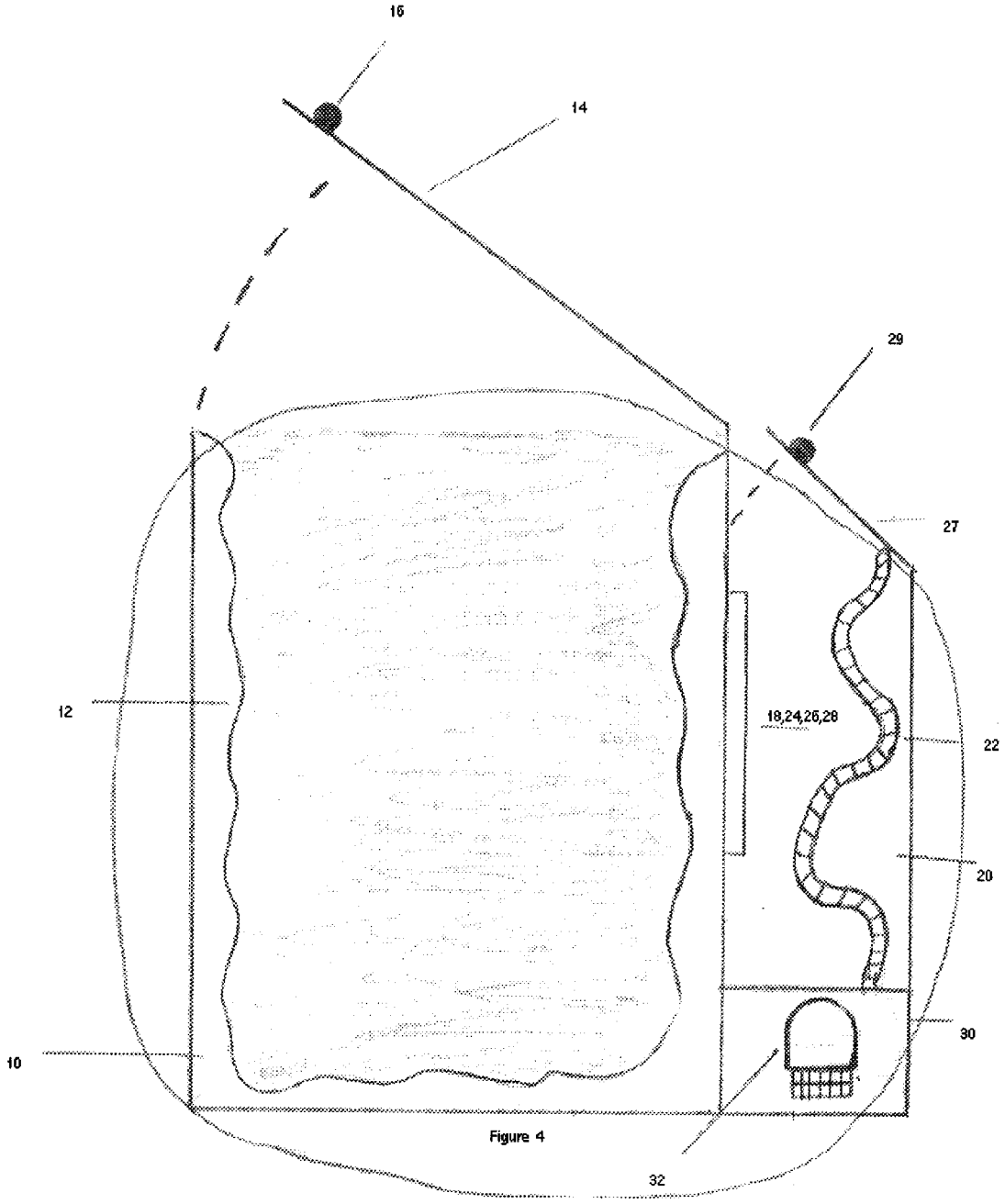
FIG. 4 is a right side view.

FIGS. 1–4 illustrate the Vac-in-a-Box system 100 of the present invention. The system 100 consists of a housing structure having a trash compartment 10, a hose storage compartment 20 and a dust bag compartment 30. The housing structure is preferably a 30 gallon trash can subdivided into the three compartments, however any size can be used to accommodate different sized families.

The trash compartment 10 contains a 30 gallon trash bag 12 and is accessible through a lid 14 with a knob 16 located in the top of the compartment 10. The hose storage compartment 20 houses a vacuum hose 22 held up by a holding hook 21, various vacuum attachments 18,24,26,28 and a junction box 23 with a control switch 25 for powering a vacuum motor 32. This compartment 20 is also accessible through a lid 27 with a knob 29 located in the top of the compartment 20. The vacuum hose 22 is a twenty-foot hose which is capable of being stretched across a room. The dust bag compartment 30 houses the vacuum motor 32 and dust bag 34 and is totally separated from the trash compartment 10. The compartment 30 is accessible through a dust bag door 35 operable by a latch 37. The vacuum hose 22 is connected to the dust bag 34 through a holder 36. The vacuum motor 32 is powered through a fourteen gauge two conductor ground wire 40. The ground wire 40 is connected to a G.F.I.(ground fault circuit interrupter) 42 which can be plugged into a normal 120 volt three prong plug. The dust bag compartment 30 also has a vent 38 for exhausting air out of the compartment 30. All of the lids and doors are hinged to the compartments.

When a spill occurs that needs to be cleaned up, one opens lid 27 to gain access to vacuum hose 22 located in the hose storage compartment 20. Depending on the type of cleaning needed, one chooses the appropriate attachment 18,24,26 or 28 to be attached to the hose 22. One then turns the control switch 25 to the on position to operate the control relay 4 to power the motor 32. This will allow one to suction any debris through the hose 22 to the dust bag 34. When the dust bag 34 becomes full, a full bag switch 44 will cause a yellow light 46 on the side of the housing to light up to notify the operator that the bag 34 is full. The system 100 is then turned off by turning the control switch 25 to the off position and the dust bag 34 can be discarded by opening the latch 37 on the dust bag door 35 and disconnecting the bag 34 from the holder 36.

Figure 5:
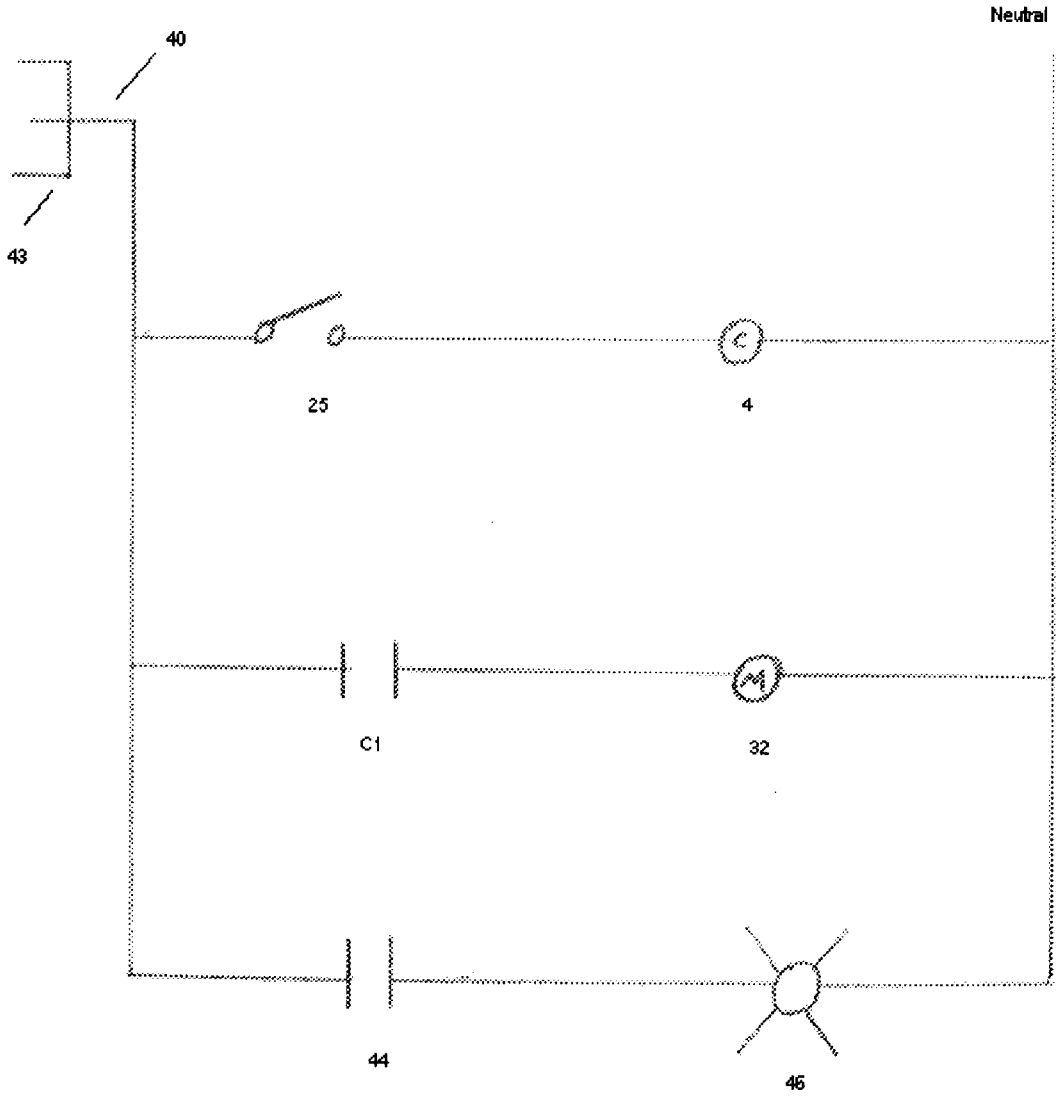
FIG. 5 is an electrical diagram of the Vac-in-a-Box system.

FIG. 5 illustrates the electrical diagram of the system 100. The Vac-in-a-Box system 100 is plugged into a typical 120 volt outlet. Once the control switch 25 is closed, current will flow through the G.F.I. 42 to the control relay 4. By energizing the control relay 4, contact C1 will close energizing the vacuum motor 32. This action will cause a suction to be pulled through the vacuum hose.

When the dust bag 34 is full the full bag switch 44 (a differential pressure switch) will close allowing electrical current to flow to the yellow light 46 located on the outside of the structure. This lets the user know it's time to change the dust bag 34.

We claim:

1. A vacuum cleaner hidden inside of a garbage collector comprising:

A. a housing structure consisting of a back exterior, an open top and three separate compartments, wherein:

i) the first compartment consists of a hollow area to be lined with a garbage bag and is accessible through the open top by a first hinged door;

ii) the second compartment, located adjacent the first compartment, houses a control switch, flexible vacuum hose and vacuum attachments and is accessible through the open top by a second hinged door;

iii) the third compartment is located beneath the second compartment and totally separate from the first compartment and houses a dust bag and an electric motor capable of creating suction, wherein a third hinged door provides access to the dust bag to allow for replacement thereof;

B. a coupling located between said second and third compartments to provide attachment of the vacuum hose to the dust bag.

2. The vacuum cleaner and garbage collector as set forth in claim 1, wherein said control switch is connected to a power source to allow activation and deactivation of said motor to allow for suctioning of dirt and dust particles from a desired location through said vacuum hose to the dust bag.

3. The vacuum cleaner and garbage collector as set forth in claim 1, further comprising a full bag light indicator in connection with the dust bag and located on the exterior of the housing structure for notifying the operator when the dust bag is full.

* * * * *